United States Patent [19]

Landa

[11] Patent Number: 4,460,286

[45] Date of Patent: Jul. 17, 1984

[54] CENTRIFUGAL BALL ELEVATOR FOR MICROBALLISTIC PRINTER

[75] Inventor: Benzion Landa, Edmonton, Canada

[73] Assignee: Savin Corporation, Stamford, Conn.

[21] Appl. No.: 386,619

[22] Filed: Jun. 9, 1982

Related U.S. Application Data

[60] Division of Ser. No. 239,891, Mar. 3, 1981, Pat. No. 4,351,617, which is a continuation of Ser. No. 39,372, May 15, 1979, abandoned.

[51] Int. Cl.[3] ..... B41J 3/02

[52] U.S. Cl. ..... 400/118; 494/65; 198/658; 198/803

[58] Field of Search ..... 400/118; 198/658, 803; 221/186; 209/689, 690; 494/65; 415/90

[56] References Cited

U.S. PATENT DOCUMENTS

| | | | |
|---|---|---|---|
| 1,712,184 | 5/1929 | Wendel | 494/65 X |
| 2,483,342 | 9/1949 | Henrard | 494/65 |
| 2,967,604 | 1/1961 | Topp | 198/642 |
| 3,904,109 | 9/1975 | Underwood | 494/65 X |
| 4,037,984 | 7/1977 | Rafferty et al. | 415/60 |

*Primary Examiner*—Paul T. Sewell

*Attorney, Agent, or Firm*—Shenier & O'Connor

[57] ABSTRACT

A centrifugal ball elevator for use in a microballistic impact printer or the like in which a hollow rotary member arranged on a generally vertical axis and having an inlet at the lower end and an outlet at the upper end is formed with an internal surface extending between the inlet and the outlet with a radius that increases from the inlet to the outlet. Balls to be elevated for recycling through the printer are supplied to the lower end of the surface through the inlet, while the member is rotated at such a speed as to impel the balls toward the outlet under the action of centrifugal force. In certain disclosed embodiments the internal surface is so formed as to entrap or filter out contaminants which have accumulated on the balls, while in another disclosed embodiment the internal surface is provided with a self-lubricating coating which lubricates the balls to reduce the abrasive effect of the balls on constricted portions of the printer through which they pass.

8 Claims, 5 Drawing Figures

CENTRIFUGAL BALL ELEVATOR FOR MICROBALLISTIC PRINTER

CROSS-REFERENCE TO RELATED APPLICATIONS

This application is a division of copending application Ser. No. 239,891, filed Mar. 3, 1981, now U.S. Pat. No. 4,351,617, which copending application is a continuation of application Ser. No. 39,372, filed May 15, 1979, abandoned.

BACKGROUND OF THE INVENTION

In my copending application, I describe a microballistic impact printer in which a graphic pattern is formed on a print receiver by successively directing solid projectiles, preferably tungsten carbide balls of about one millimeter diameter, at respective points on the print receiver making up the desired pattern. In the disclosed printer, the projectiles are directed at the desired points on the surface of the print-receiving medium, which may be paper supported on a platen and covered by a carbon ribbon or the like, by firing them in succession from a single gun which is controllably moved about orthogonal axes intersecting at a fixed pivot point for aiming the gun at the respective points. By using successively fired projectiles rather than, for example, a two-dimensional array of individually activated reciprocating wires, I am able to reduce significantly the bulk and expense of the overall printer. In addition, since the gun is continuously adjustable rather than being aimed at a fixed point on the print-receiving medium, I am able to produce a pattern of overlapping dots, greatly improving the appearance of the printed character. Furthermore, my microballistic impact printer also represents a substantial improvement over prior-art inkjet printers by virtue of the greater controllability of solid projectiles, the elimination of splattering problems, and the ability of the impact printer to make carbon copies.

Since, in the disclosed system, the anticipated firing rate is on the order of 1000 balls per second for a particular gun, some means for retrieving and recycling previously fired balls is necessary as a practical matter to avoid the requirement of an inordinately large ball supply. Readily available devices for achieving such recycling are relatively noisy and cumbersome, as well as being liable to jamming.

If balls are to be recycled in the disclosed system, it is also highly desirable that the balls be lubricated, or cleaned of contaminants that have accumulated on the ball surfaces as the balls move repeatedly through the system. Otherwise, the useful life of the breech, through which the balls are urged to propel them from the gun, is severely shortened.

FIELD OF THE INVENTION

My invention relates to an apparatus for elevating or otherwise transporting solid objects in bulk in a continuous manner and, more particularly, to a centrifugal elevator for recycling balls used as projectiles in a microballistic impact printer.

DESCRIPTION OF THE PRIOR ART

Rafferty et al U.S. Pat. No. 4,037,984 discloses a pump for moving blood or other delicate fluid materials, including suspensions, precipitates and liquid-solid mixtures, from an inlet adjacent the smaller-diameter end of a rotating conical surface to an outlet at the larger-diameter end of the surface. While this and other art show the use of a hollow rotating conical member to move fluid material, they do not show or suggest the use of a similar member to transport solid objects in bulk and, in particular, do not suggest the use of such a member to recycle projectiles that are propelled from apparatus such as a microballistic impact printer.

Topp U.S. Pat. No. 2,967,604 discloses a spinner for distributing granular materials comprising a hollow conical frustum with a closed bottom, onto which material to be distributed is loaded. While the apparatus disclosed in the patent is similar in some respects to that disclosed herein, it is designed to distribute material radially rather than transport it axially. Nor would the apparatus disclosed in the patent be suitable for the latter function, owing to the closure of the bottom of the inverted conical frustum.

SUMMARY OF THE INVENTION

In general, my invention contemplates apparatus for elevating or otherwise transporting objects such as balls in which a hollow rotary member having an inlet and an outlet is formed with an internal surface of revolution, extending between the inlet and the outlet, with a radius that increases from the inlet to the outlet. The internal surface portion adjacent the inlet extends into a reservoir formed for receiving the objects to be transported so that the objects contact the internal surface, and the member is rotated at such a speed as to impel the objects along the surface toward the outlet under the action of centrifugal force. While such apparatus may be used to transport a wide variety of solid objects in bulk, unaided by the force of gravity, it is especially suitable for the particular use disclosed herein of recycling balls or other solid projectiles after they have been propelled from the gun of a microballistic impact printer.

According to a preferred feature of my invention, the internal surface of the rotary member is adapted to clean the balls or other objects as they move along the surface toward the outlet. By "clean" is meant any treatment or method that will make the balls smooth or slippery so as to minimize any wear to the ball gun as the balls are urged through its breech. Such methods include, for example, directing the balls along an internal surface formed of a material, such as velvet or other pile fabric, adapted to trap contaminants adhering to the balls as they move along the surface, directing the balls along an internal surface which is perforated so that it filters out the contaminants, or directing the balls along an internal surface formed of a material that actually applies a lubricant to the ball surfaces. Whichever method is used, the internal surface of the rotary member has the decided advantage over other available surfaces along the ball recycling path that the centrifugal force created by rotating the member urges the balls against the internal surface reliably and with a force several times that of gravity, greatly enhancing the trapping, filtering or other cleaning action. By contrast, if the cleaning surface were located elsewhere along the ball recycling path, contact between the balls and such a surface would be sporadic and uncontrolled, owing to the constant rebounding of the balls.

OBJECTS OF THE INVENTION

One object of my invention is to provide an apparatus for transporting solid objects in bulk, unaided by the force of gravity.

Another object of my invention is to provide an apparatus for transporting solid objects in bulk which is simple and inexpensive.

Still another object of my invention is to provide an apparatus for transporting solid objects in bulk which is relatively silent in operation and insusceptible to jamming.

A further object of my invention is to provide an apparatus for transporting solid objects in bulk which is especially suitable for recycling the projectiles of a microballistic printer or other apparatus in which projectiles are used in recycling fashion.

A still further object of my invention is to provide apparatus which is effective to lubricate the projectiles that are recycled to a microballistic printer or other apparatus after being propelled thereform.

Other and further objects will be apparent from the following description.

BRIEF DESCRIPTION OF THE DRAWINGS

In the accompanying drawings which form part of the instant specification and which are to be read in conjunction therewith and in which like reference numerals indicate like parts in the various views.

DESCRIPTION OF THE PREFERRED EMBODIMENTS

Figure 1:
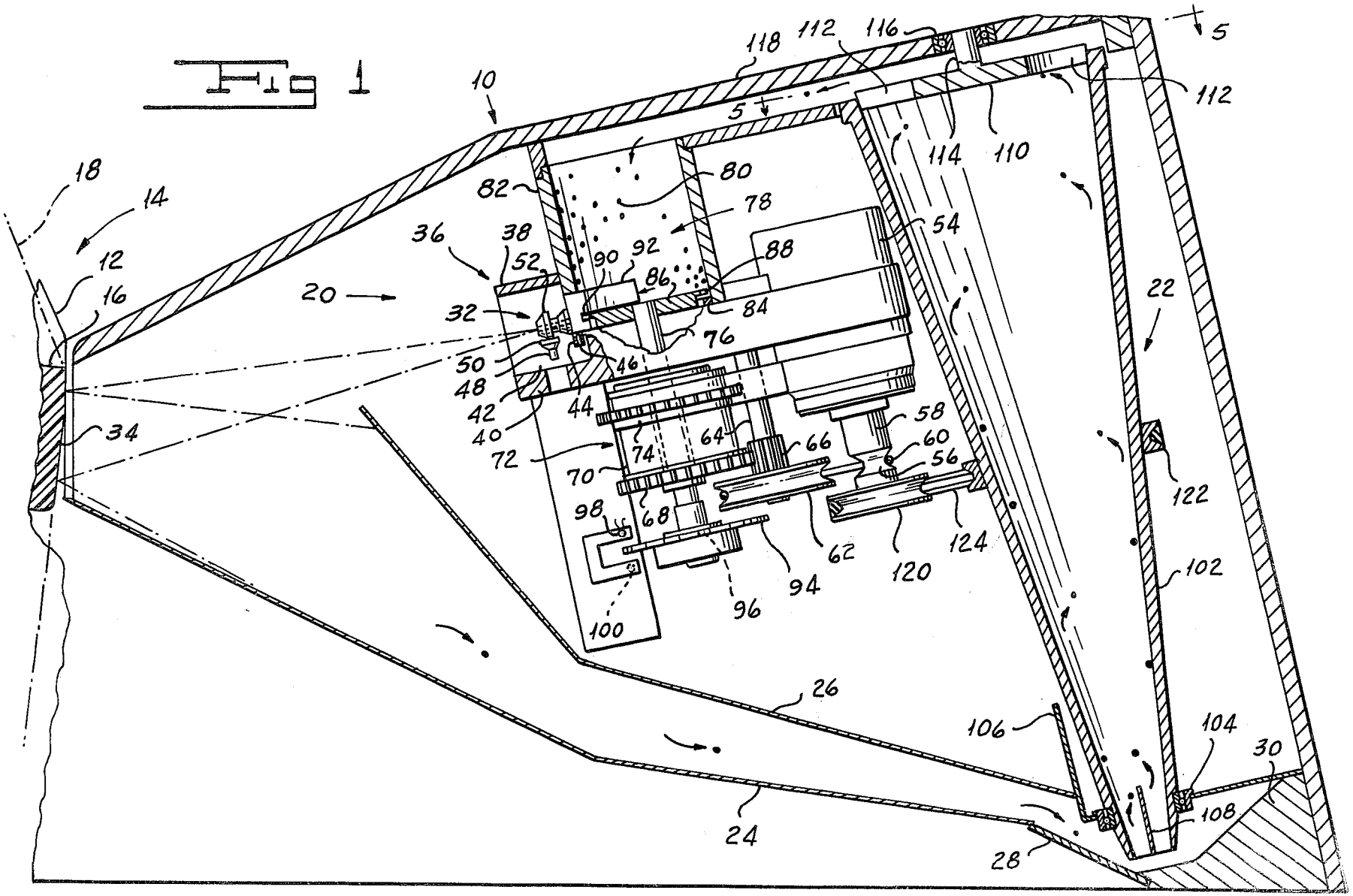
FIG. 1 is a fragmentary section of one form of my centrifugal ball elevator, together with the microballistic impact printer in which it is incorporated.

Referring now to FIG. 1, a printer, indicated generally by the reference character 10, incorporating my ball return device includes spaced sidewalls 12 connected at the upper front end thereof by a crosspiece (not shown) secured to the walls by any suitable means. The paper and carbon ribbon section, indicated generally by the reference character 14, of my printer includes a platen 16 secured between sidewalls 12 by any appropriate means and formed of any suitable material, such as Plexiglas, which is the registered trademark of Rohm and Haas Co. of Philadelphia, Pa., for an acrylic resin. Platen 16 supports an impact-sensitive print-receiving medium 18 of any suitable type, such as a sheet of ordinary paper covered by a carbon ribbon (not separately shown). A fuller description of the printer 10, while unnecessary for an understanding of the operation of the present invention, may be found in the previously identified application Ser. No. 239,891, the disclosure of which is incorporated herein by reference.

The microballistic printer 10 includes a projectile propelling section, indicated generally by the reference character 20, to which balls are fed in a manner to be described by my ball return device, indicated generally by the reference character 22. Balls are propelled from the assembly 20 toward the platen 16 along paths such as those which are indicated in dot-dash lines in FIG. 1. Balls which rebound from the portion of the printing medium 18 extending across the platen are collected between a lower guide 24 and an upper guide 26 and directed toward a region, at the lower end of device 22, formed by a guide plate 28 and by the upper surface of a cross brace 30 secured between the walls 12 by any suitable means.

In the projectile propelling section 20, a gun assembly indicated generally by the reference character 32 is adapted to direct projectiles such as balls toward the surface 34 of the platen 16 which is disposed behind the printing medium. The gun assembly 32 may be disposed, for example, in a housing indicated generally by the reference character 36 having a top 38, a bottom 40, and sidewalls 42. A gimbal ring 44 is supported by a pair of pivot pins, shown in the previously identified copending application, which are aligned on a horizontal axis and carried by the respective sidewalls 42. The pivot pins support the gun assembly 32 for movement about one axis which lies in a plane generally parallel to the plane of the paper and which may be said to be, for example, the "X" axis. Ring 44 carries a pair of axially aligned pivot pins 46 which support the gun assembly 32 for movement around an axis which is generally perpendicular to the axis of the pins (not shown) supporting the ring and which may be considered the "Y" axis. A Y-deflector rod 48 having a head 50 abutting a camming surface 52 carried at the front of the gun 32 is controllably actuated by means shown in the copending application to deflect the gun 32 the desired extent along the Y-axis to strike a desired point on the medium forming part of the pattern being reproduced. In a similar manner, an X-deflector rod also shown in the copending application, abutting camming surface 52 from a direction perpendicular to that of rod 48, is controllably actuated to deflect the gun 32 the desired extent along the Y-axis to propel a projectile at the desired impact point on the medium 18.

A motor 54 is adapted to be energized to drive a first pulley member 56 formed in the motor shaft 58. A belt 60 couples pulley 56 to a pulley 62 carried by an idler shaft 64b supported on the machine frame. Shaft 64 carries a pinion 66 which meshes with a gear 68 carried by the input element 70 of a slip clutch indicated generally by the reference character 72. Clutch 72, which may be of any suitable type known to the art, includes an output element 74 carried by a shaft 76 for rotation therewith. Further, as is known in the art, so long as the output member 74 is restrained against rotary movement, the input member 70 will rotate relative thereto. However, when the member 74 is free to rotate, clutch 72 clutches the element 70 and 74 so that shaft 76 is driven by shaft 58.

The microballistic printer 10 includes a cylindrical storage bin, indicated generally by the reference character 78, including a sidewall 82 and an annular bottom 84. Bin 78 is adapted to store a quantity of balls 80 formed of any suitable material, such as tungsten carbide. Shaft 76 carries for rotation therewith a projectile or ball feeding element in the form of a saw blade 86 having a plurality of teeth 88. Balls 80 returned to the bin 78 in a manner to be described hereinbelow fall down onto the bottom ring 84. As the shaft 76 rotates, teeth 88 carry the balls 80 along the ring 84 and into a guide or separator member 92 having an outlet passage, shown in my copending application, leading to the gun assembly 32. In order to permit the balls 80 to be fed rapidly to the gun assembly 32, and for the ready release of the balls 80 from the spaces between the teeth 88 of the blade 86, I make the peripheral portion of the blade 86 about half the thickness of a ball 80. Guide 92 is formed with a slot 90 through which the blade teeth pass as they move into the guide 92. Slot 90 is formed with a width which is smaller than the diameter of the balls 80 to facilitate separation of the balls 80 from the saw blade.

Shaft 76 also carries for rotation therewith a counter disc 94 provided with a plurality of holes 96 corresponding in number to the number of teeth 88 on saw blade 86. A portion of disc 94 carrying the holes 96 is adapted to move through the space between a source of illumination 98 and aphotodetector 100 to cause the photodetector to put out a signal each time a ball is fed into the passage of the guide 92 by the blade 86. Thus, photodetector 100 puts out a digital signal indicating the number of balls which are fed during the period of time for which the clutch 72 is energized. As described in detail in my copending application, this signal serves as a synchronizing signal for controlling the deflection of the gun 32 about its pivot axes and the disabling of the injector blade 86 between successive character strokes.

Figure 5:
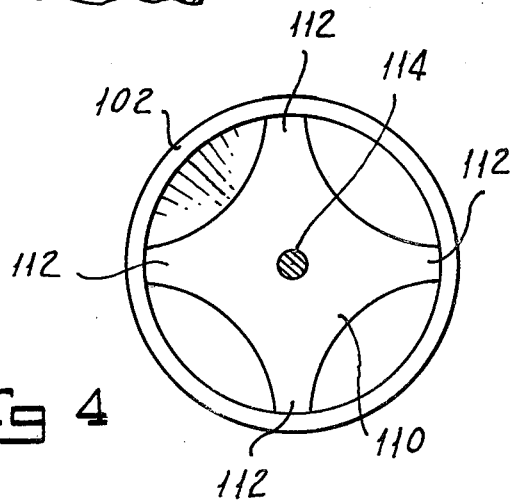
FIG. 5 is a section of the ball elevator shown in FIG. 1, taken along line 5—5.

The centrifugal ball return system 22 that is the subject matter of this application includes a hollow member 102 supported for rotary movement in a bearing 104 carried by a bracket 106 on the machine frame. Preferably, member 102 is either conical as shown or otherwise formed with a radius that increases at a nonincreasing (i.e., constant or descreasing) rate from the inlet at the bottom to the outlet at the top so that the weak centrifugal force acting on the balls 80 at the inlet is readily able to overcome the gravitational force tending to draw the balls downwardly out of the member 102. The lower open end of the member 102 is disposed in the space formed by plate 28 and crosspiece 30 to which balls bounding off the platen are returned by guides 24 and 26. I provide the lower end of member 102 with a crosspiece 108 which assists the balls in entering the member 102 and moving upwardly along the inner wall thereof when the member 102 rotates in a manner to be described. Crosspiece 108, which acts as a centrifugal impeller, is restricted to the lower, inlet end of member 102, where the radius and hence linear velocity of the member is smallest, to avoid unduly violent impacts between the balls 80 and the crosspiece. Referring now also to FIG. 5, I secure a cap 110 formed with a plurality of radially extending circumferentially spaced arms 112 in the upper end of member 102. A shaft 114 on the cap 112 is rotatably received in a bearing 116 supported on the cover plate 118 on the gun portion of my microballistic printer. A pulley 120 carried by shaft 58 for rotation therewith is connected by a belt 124 to a pulley 122 formed on the outside of member 102, so that as motor 54 is driven to spin the member 102 about its axis, balls from the return space adjacent to the bottom of member 102 enter the member and under the action of centrifugal force travel upwardly along the inner surface and through the space between arms 112 which hurl the balls along a passage leading to the bin 78.

In the apparatus shown in FIG. 1, it is highly desirable that the balls 80 be periodically cleaned of dirt or contaminants which accumulate on their surface, in order to prevent the breech of the gun 32, shown in my copending application and through which the balls are snapped when fired, from prematurely wearing out. I have found that a particularly suitable location for removing such contaminants is the internal surface of the conical member itself, since the balls 80 are urged into engagement with this surface with a force many times that of gravity.

Figure 2:
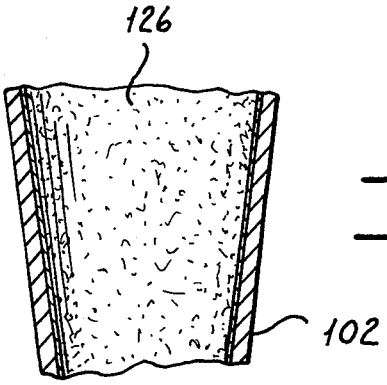
FIG. 2 is a fragmentary section of an alternative form of my ball elevator, which is adapted to entrap accumulated dirt particles on the balls being elevated.
Figure 3:
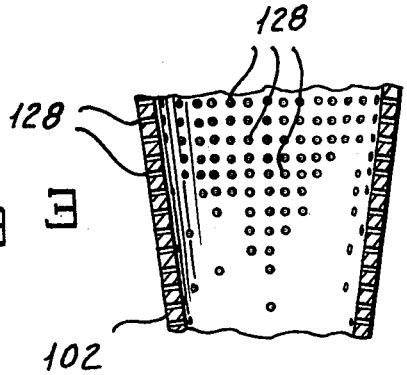
FIG. 3 is a fragmentary section of another alternative form of my ball elevator, adapted to entrap accumulated dirt particles.
Figure 4:
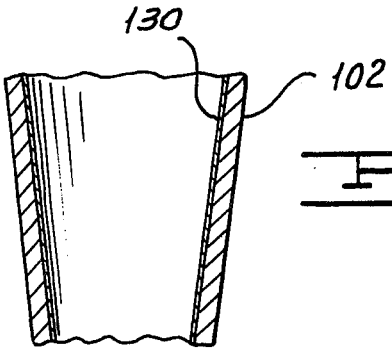
FIG. 4 is a fragmentary section of still another alternative form of my ball elevator which is adapted to lubricate balls being elevated.

In FIG. 2 I show a modified form of the conical member 102 of FIG. 1 in which the inner surface of the member is provided with a lining 126 of a material such as velvet which traps dust particles which have accumulated on the balls 80. In FIG. 3 I show another modified form of the member 102 which is provided with a plurality of perforations 128 (shown on an exaggerated scale in the figure); perforations 128 are smaller in diameter than the balls 80 so that the conical member 102 acts as a sieve through which accumulated particles are filtered under the action of centrifugal force. In FIG. 4 I show still another modified form of the conical member 102 which, this time, is provided with a coating of a lubricating material 130 of any suitable type known to the art. Coating 130 functions somewhat differently from lining 126 and perforations 128 in that the coating 130 not only cleans the balls 80 of accumulated dirt, but also supplies those balls 80 with lubricant to lessen the abrasive action of the balls on the gun 32 through which they are directed.

It will be seen that I have accomplished the objects of my invention. My apparatus transports balls or other solid objects in bulk, unaided by the force of gravity. My apparatus is simple and inexpensive, while at the same time being relatively silent in operation and insusceptible to jamming. Finally, my apparatus is especially suitable for recycling and lubricating the projectiles of a microballistic impact printer or other apparatus in which projectiles are used in recycling fashion.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention what I claim is:

1. Apparatus for transporting solid objects including in combination a hollow rotary member having an inlet and an outlet and having means forming an internal surface of revolution extending between said inlet and said outlet, said internal surface having a radius that increases monotonically from said inlet to said outlet, means for supplying said objects to said surface through said inlet, and means for rotating said member to impel said objects along said surface toward said outlet under the action of centrifugal force, said surface-forming means including means for cleaning the contacting portions of said objects as they move along said surface.

2. Apparatus for transporting solid objects including in combination a hollow rotary member having an inlet and an outlet and having means forming an internal surface of revolution extending between said inlet and said outlet, said internal surface having a radius that increases monotonically from said inlet to said outlet, means for supplying said objects to said surface through said inlet, and means for rotating said member to impel said objects along said surface toward said outlet under the action of centrifugal force, said surface-forming means including means for trapping contaminants adhering to the contacting portions of said objects as they move along said surface.

3. Apparatus for transporting solid objects including in combination a hollow rotary member having an inlet and an outlet and having an internal surface of revolution extending between said inlet and said outlet, said internal surface having a radius that increases monotonically from said inlet to said outlet, means for supplying said objects to said surface through said inlet, and means for rotating said member to impel said objects along said surface toward said outlet under the action of centrifugal force, said internal surface being formed of a pile fabric material adapted to trap contaminants adhering to said objects as said objects move along said surface.

4. Apparatus as in claim 3 in which said pile fabric material comprises velvet.

5. Apparatus for transporting solid objects of predetermined size including in combination a hollow rotary member having an inlet and an outlet and having an internal surface of revolution extending between said inlet and said outlet, said internal surface having a radius that increases monotonically from said inlet to said outlet, means for supplying said objects to said surface through said inlet, and means for rotating said member to impel said objects along said surface toward said outlet under the action of centrifugal force, said member being formed with perforations opening onto said internal surface over a substantial portion of said surface, said perforations being smaller than said objects to filter contaminants adhering to said objects as said objects move along said surface.

6. Apparatus for transporting solid objects including in combination a hollow rotary member having an inlet and an outlet and having an internal surface of revolution extending between said inlet and said outlet, said internal surface having a radius that increases monotonically from said inlet to said outlet, means for supplying said objects to said surface through said inlet, and means for rotating said member to impel said objects along said surface toward said outlet under the action of centrifugal force, said member including means for applying a lubricant to said objects as they move along said surface.

7. Apparatus including in combination means for successively propelling a plurality of solid projectiles and means for recycling said projectiles to said propelling means after they have been propelled therefrom, said recycling means including a hollow rotary member having an inlet and an outlet and having means forming an internal surface of revolution extending between said inlet and said outlet, said outlet having a peripheral portion immediately adjacent to said internal surface, said surface having a radius that increases monotonically from said inlet to said outlet, means for supplying said projectiles to said surface through said inlet, means for rotating said member to impel said projectiles along said surface through said peripheral portion of said outlet under the action of centrifugal force, said surface-forming means including means for cleaning the contacting portions of said objects as they move along said surface, and means for directing projectiles that have traversed said peripheral portion of said outlet to said propelling means.

8. Apparatus as in claim 6 in which said means for applying a lubricant comprises a coating of a lubricating material on the internal surface of said member.

* * * * *